US009171456B2

(12) United States Patent
Ramchandani et al.

(10) Patent No.: US 9,171,456 B2
(45) Date of Patent: Oct. 27, 2015

(54) KEY FOB DONGLE

(71) Applicant: RB Distribution, Inc., Colmar, PA (US)

(72) Inventors: Kris Ramchandani, Harleysville, PA (US); Venkataramani Kumar, Lansdale, PA (US)

(73) Assignee: RB Distribution, Inc., Colmar, PA (US)

( * ) Notice: Subject to any disclaimer, the term of this patent is extended or adjusted under 35 U.S.C. 154(b) by 0 days.

(21) Appl. No.: 14/656,218

(22) Filed: Mar. 12, 2015

(65) Prior Publication Data

US 2015/0187208 A1 Jul. 2, 2015

Related U.S. Application Data

(63) Continuation of application No. 14/512,852, filed on Oct. 13, 2014.

(60) Provisional application No. 61/889,898, filed on Oct. 11, 2013.

(51) Int. Cl.

| | |
|---|---|
| ***G08C 19/16*** | (2006.01) |
| ***G08C 17/02*** | (2006.01) |
| *G07C 9/00* | (2006.01) |

(52) U.S. Cl.

CPC ..... *G08C 17/02* (2013.01); *G07C 9/00309* (2013.01); *G07C 9/00007* (2013.01); *G07C 2009/00793* (2013.01); *G07C 2009/00865* (2013.01); *G08C 2201/20* (2013.01); *G08C 2201/50* (2013.01)

(58) Field of Classification Search

CPC ..... G07C 9/00007; G07C 9/00103; G07C 9/00182; G07C 9/00309; G07C 2009/00761; G07C 2009/00769; G07C 2009/00793; G07C 2009/00865; B60R 25/24; B60R 2325/101

USPC ..... 340/12.28

See application file for complete search history.

(56) References Cited

U.S. PATENT DOCUMENTS

| | | | | |
|---|---|---|---|---|
| 5,864,297 | A * | 1/1999 | Sollestre et al. | 340/5.23 |
| 6,941,203 | B2 * | 9/2005 | Chen | 701/31.6 |
| 7,315,238 | B2 * | 1/2008 | Chambers | B60R 25/24 340/12.23 |
| 8,466,774 | B2 * | 6/2013 | Lopez | B60R 25/24 340/5.61 |
| 8,626,331 | B2 | 1/2014 | Marsh et al. | |
| 8,634,951 | B2 | 1/2014 | Freeman | |

(Continued)

FOREIGN PATENT DOCUMENTS

WO 2009010919 A3 1/2009

OTHER PUBLICATIONS

Advanced Diagnostics USA. (Sep. 6, 2013).World Leader in Transponder Key Programming-mvptcodesupport. Retrieved from https://web.archive.org/web/20130906051317/http://www.mvptcodesupport.com/, pp. 1-2.*

*Primary Examiner* — Firmin Backer
*Assistant Examiner* — Adnan Aziz
(74) *Attorney, Agent, or Firm* — Volpe and Koenig, P.C.

(57) ABSTRACT

A dongle for programming a replacement key fob transmitter to a vehicle. The dongle mates to the vehicle's on-board electronics through the Data Link Connector. A diagnostic circuit in the dongle determines a communications protocol for programming a key fob transmitter to the vehicle. Audio and visual indicators are provided to indicate that communications are established and to indicate the successful programming of the key fob transmitter to the vehicle.

16 Claims, 7 Drawing Sheets

(56) References Cited

U.S. PATENT DOCUMENTS

| | | | | |
|---|---|---|---|---|
| 8,682,468 | B2 | 3/2014 | Marsh et al. | |
| 8,841,987 | B1 * | 9/2014 | Stanfield | G07C 9/00896 340/5.61 |
| 8,979,446 | B2 | 3/2015 | Freeman | |
| 2004/0122542 | A1 | 6/2004 | Yang | |
| 2005/0177284 | A1 * | 8/2005 | Kugumiya et al. | 701/1 |
| 2005/0248436 | A1 * | 11/2005 | Hohmann et al. | 340/5.72 |
| 2006/0208069 | A1 * | 9/2006 | Gilbert | B60R 25/24 235/382.5 |
| 2007/0001805 | A1 * | 1/2007 | Utter | B60R 25/24 340/5.72 |
| 2007/0296559 | A1 * | 12/2007 | Fehr | 340/426.2 |
| 2008/0150685 | A1 * | 6/2008 | Desai et al. | 340/5.61 |
| 2009/0160607 | A1 * | 6/2009 | Edwards et al. | 340/5.61 |
| 2009/0276115 | A1 * | 11/2009 | Chen | 701/32 |
| 2009/0278656 | A1 * | 11/2009 | Lopez et al. | 340/5.72 |
| 2010/0205450 | A1 * | 8/2010 | Sarnacke et al. | 713/185 |
| 2010/0293081 | A1 * | 11/2010 | Liu et al. | 705/34 |
| 2011/0288954 | A1 * | 11/2011 | Bertosa et al. | 705/26.9 |
| 2013/0141212 | A1 * | 6/2013 | Pickering | 340/5.61 |

* cited by examiner

KEY FOB DONGLE

CROSS REFERENCE TO RELATED APPLICATION(S)

This application claims the benefit of U.S. application Ser. No. 14/512,852, filed on Oct. 13, 2014, which claims the benefit of U.S. provisional application No. 61/889,898 filed Oct. 11, 2013, both of which are incorporated by reference as if fully set forth.

BACKGROUND

Cars increasingly require a programmable key fob for keyless entry. The programmable key fob contains codes that are specific to a car's onboard computer. If the programmable key fob is lost, the usual source for acquiring a new one is through the dealership. The dealership has the capabilities, including the required programmer, to tap into the car's onboard computer and program a new key fob. Because the dealership programmer includes many extraneous functions besides being able to program the programmable key fob, the dealership performs this function at an extremely high cost to the consumer and the procedure is time consuming. There is a need for a programmable key fob that can be programmed by a consumer using a lower cost programmer tool.

SUMMARY

Disclosed herein is an improvement in the methods and systems used to configure electronic components and modules for a vehicle. A low cost programmer tool, or key fob dongle, may be useful for managing devices coupled to a vehicle's communication network.

A dongle and method for using it are disclosed. The dongle is configured to support a method where the dongle is inserted into a vehicle's on-board diagnostic (OBD)-II connector, transmits a communication detection request to the OBD-II connector, and beeps a predetermined amount of times in response to the communication detection request, whereby the predetermined amount of beeping identifies a vehicle communication protocol.

Disclosed herein is vehicle specific dongle and an improved method or system for configuring electronic components and modules to the vehicle. A low cost programmer tool, key fob dongle, or dongle may be configured to manage multiple devices coupled to the vehicle communication network.

The scan tool method of synchronizing Keyless Entry Transmitters to a vehicle's receiver used by the dealer, is replaced with a vehicle specific, limited use OBD-II programmer, or dongle. The key fob dongle, when connected directly to a vehicle OBD-II connector (Data Link Connector), in a vehicle network port, initiates a process of registering a maximum number (for example, four) of remote wireless keyless entry transmitters.

The key fob dongle is a low cost alternative and solution to procedures that previously required the use of a scan tool. It enables key fobs to be paired to a keyless entry receiver of a vehicle by a consumer rather than through an Original Equipment Manufacturer (OEM) Tester.

BRIEF DESCRIPTION OF THE DRAWINGS

A more detailed understanding may be had from the following description, given by way of example in conjunction with the accompanying drawings wherein.

DETAILED DESCRIPTION

This invention is described in the following description with reference to the Figures, in which like reference numbers represent the same or similar elements.

An example of a method of operation includes the following steps. First there is provided a dongle with a specific vehicle application than can initiate an automatic detection of vehicle communication interfaces. For a given vehicle application, a maximum number (for example, four) of communication systems may be enabled in the key fob dongle to transmit and receive data in accordance with standard communication protocols developed for onboard diagnostics (OBD)-II systems such as ISO15765-4 CAN (Both High Speed and Single Wire CAN), ISO 9141-2 (K-Line), KW2000 and J1850 (Both VPW and PWM variations). Next, the onboard computer identifies modules coupled to the vehicular communication network, for example, the key fob dongle. Then, the specifically configured key fob dongle can enter the particular use mode to initiate or enable installation of required data to the replacement part, for example a programmable key fob.

In-vehicle networking is a method for transferring data between electronic modules via a serial data BUS. The Society Automotive Engineers (SAE) standards include the following three categories of in-vehicle network communications: Class A, Class B, and Class C. Class A may be low speed (less than 10 Kb/s) and used for convenience features, such as entertainment. Class B may be medium speed (between 10 and 125 Kb/s) and used for general information transfer, such as emission data and instrumentation. Class C may be high speed (greater than 125 Kb/s) and may be used for real-time control, such as traction control, brake by wire, and the like.

All cars and light trucks built for sale in the United States after 1996 are required to be OBD-II compliant. There are five OBD-II protocol types in use: J1850 PWM, J1850 VPW, ISO 9141-2, ISO 14230 KWP2000, and ISO 15765 CAN. Each protocol differs electrically and by communication format. The key fob dongle must be compatible with the vehicle specific protocol in order to communicate with the OBD-II of the vehicle.

Figure 1:
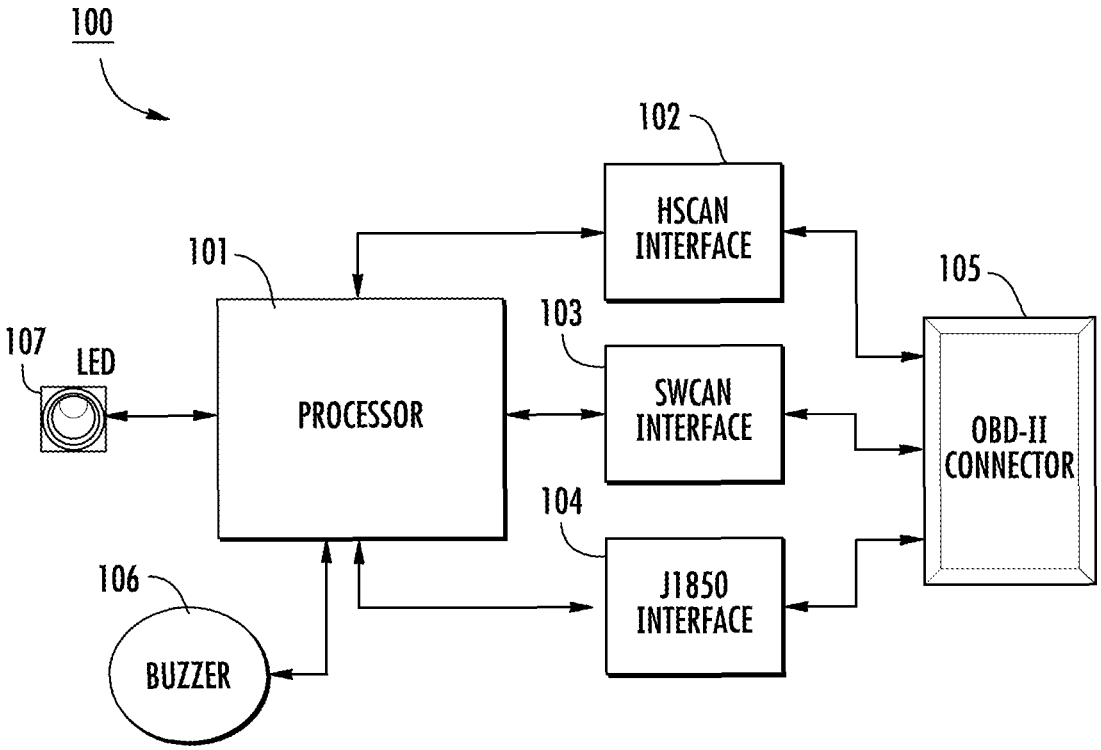
FIG. 1 is an example system block diagram of the key fob dongle.

FIG. 1 is a block diagram depicting the operation of the key fob dongle. The key fob dongle 100 includes a processor 101 that is connected to the three interfaces 102, 103, and 104. The first interface 102 is a High Speed Control Area Network (HSCAN) interface. Controller Area Network (CAN) was designed for automotive applications needing high levels of data and data rates of up to 1 Mbit/s. In 2006 over 70% of all automobiles sold in North America utilized CAN BUS technology. Beginning in 2008, the SAE required 100% of the vehicles sold in the USA to use the CAN BUS communication protocol. CAN messages have a specified structure dictated by CAN standards. CAN networks have rules for dealing with colliding messages when two modules begin transmitting messages at the same time. HSCAN is classified as a Class C network for both vehicle network and diagnostic communication.

The second interface 103 is a Single Wire CAN (SWCAN) interface. SWCAN is classified as a Class B network for both vehicle network and diagnostic communication. A CAN physical layer (developed by General Motors) uses only one wire at all times that limits its speed performance to 33.33 kbit/s.

The third interface 104 is a J1850 interface. This is the SAE standard for Class A and Class B (slow and medium speed) networks. It is a combination of Ford's SCP and General Motors' Class 2 protocol. As J1850 developed from two proprietary protocols, there are two alternative J1850 protocols: 41.6 Kb/s with pulse width modulation and 10.6 Kb/s with variable pulse width. J1850 10.4 VPW is used by General Motors, which internally calls this protocol Class 2. Class 2 is a true network protocol that incorporates BUS arbitration. Class 2 is used for both vehicle network and diagnostic communication.

Each of the three interfaces 102, 103, and 104 connects to a vehicle OBD-II connector 105. The vehicle OBD-II connector 105 is part of the car's onboard computer. Connecting the dongle 100 to the vehicle OBD-II connector 105 establishes access to the codes necessary to program a replacement part, such as a programmable key fob. Once the dongle 100 is connected to the vehicle OBD-II connector 105, a signal is transmitted back to the processor 101 through one of the three interfaces 102, 103, and 104. That signal is transmitted to the processor 101 and indicates to the user either by the LED light 107 or by the buzzer 106 that the key fob dongle 100 is ready to start programming the programmable part.

The dongle automatically detects a vehicle communication protocol once it has been inserted into the OBD-II connector. The classification of communication protocol can be detected through the buzzer sound once it has been inserted into the OBD-II connector. If the buzzer beeps 3 times, the communication protocol for the key fob learning method is J1850. If the buzzer beeps 2 times, the communication protocol is SWCAN. If the buzzer beeps once, the communication protocol is HSCAN. Once the communication has been established, the learning process can begin.

As soon as the learning process is ready, the user should Press and hold the LOCK and UNLOCK buttons simultaneously on the key fob for 10 seconds. After learning is completed either the instrument cluster in the car or the dongle will give an audible sound, confirming the new part or component has been paired. The same procedure will be applied to the next key fob or component.

In the preferred device, it programs a maximum number of key fobs in one session. A two minute time-out period is set per session with an audible indication alerting the user to the remove device from the OBD-II connector. The preferred dongle has a counter that limits the number of sessions allowed with the dongle.

Figure 2:
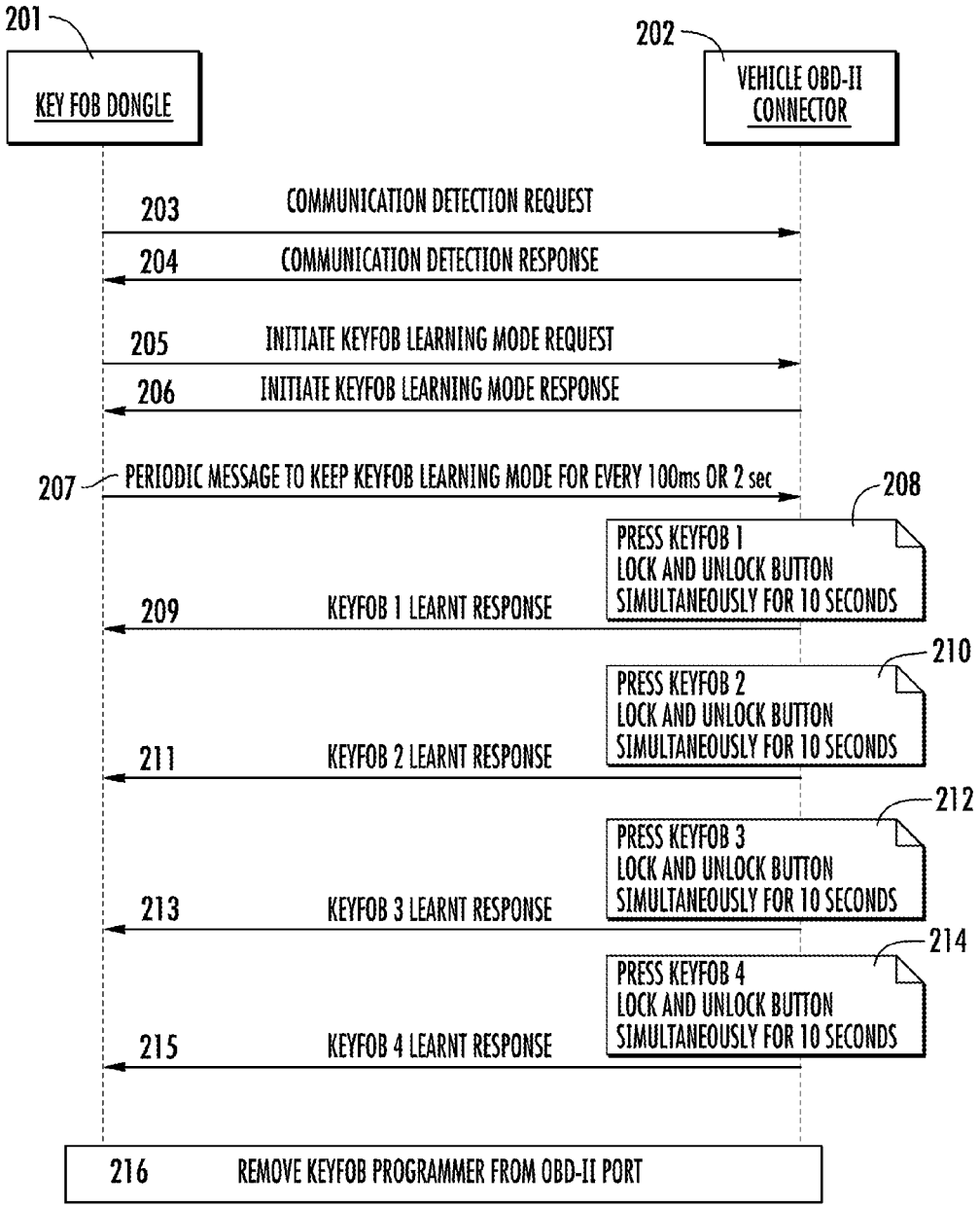
FIG. 2 is an example software flow diagram.

FIG. 2 is an exemplary software flow diagram for using the dongle to program a key fob. In FIG. 2, the dongle 201 sends a communication detection request 203 to the vehicle OBD-II connector 202. The vehicle OBD-II connector 202 sends a communication detection response 204 to the dongle 201. The dongle 201 sends an initiate key fob learning mode request 205 to the vehicle OBD-II connector 202. The vehicle OBD-II connector 202 sends an initiate learning mode response 206 to the dongle 201.

The dongle 201 sends periodic messages 207 to the vehicle OBD-II connector 202 to keep the key fob in learning mode for every 100 ms or 2 seconds. On a first key fob, Key Fob 1, the LOCK and UNLOCK buttons are pressed simultaneously for 10 seconds 208 communicating with the vehicle OBD-II connector 202. The vehicle OBD-II connector 202 sends a Key Fob 1 learnt response 209 to the key fob dongle 201.

On a second key fob, Key Fob 2, the LOCK and UNLOCK buttons are pressed simultaneously for 10 seconds 210 communicating with the vehicle OBD-II connector 202. The vehicle OBD-II connector 202 sends a Key Fob 2 learnt response 211 to the key fob dongle 201.

On a third key fob, Key Fob 3, the LOCK and UNLOCK buttons are pressed simultaneously for 10 seconds 212 communicating with the vehicle OBD-II connector 202. The vehicle OBD-II connector 202 sends a Key Fob 3 learnt response 213 to the key fob dongle 201.

On a fourth key fob, Key Fob 4, the LOCK and UNLOCK buttons are pressed simultaneously for 10 seconds 214 communicating with the vehicle OBD-II connector 202. The vehicle OBD-II connector 202 sends a Key Fob 4 learnt response 215 to the key fob dongle 201. After the last key fob, Key Fob 4, is learned, the user can remove the key fob dongle 201 from the vehicle OBD-II connector 202.

Figure 3:
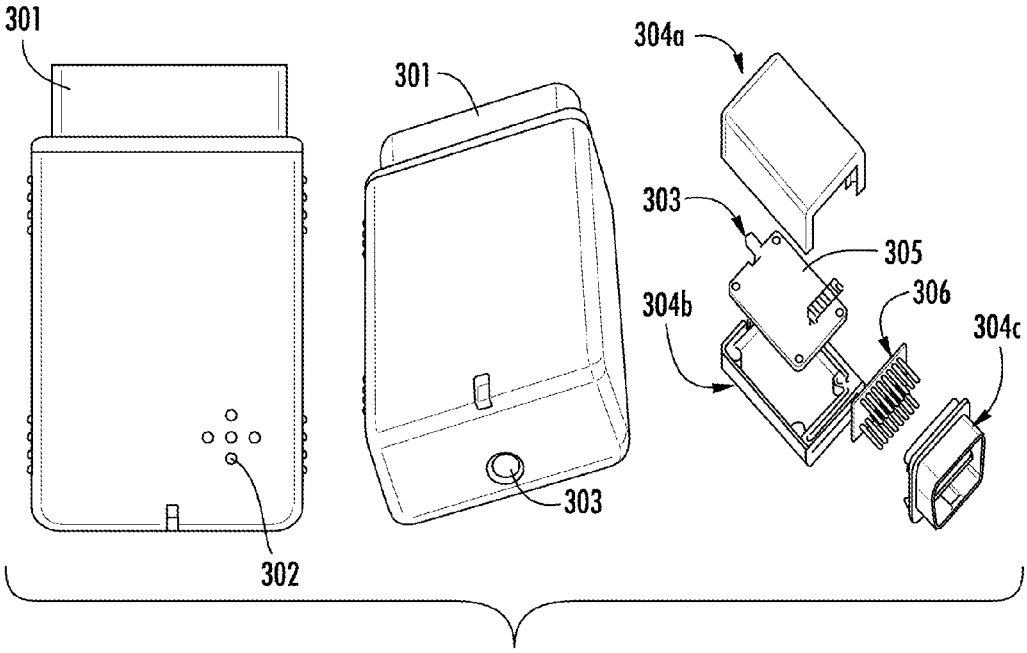
FIG. 3 is an example view of the key fob dongle enclosure.

FIG. 3 is an example view of the key fob dongle enclosure. The key fob dongle 301 includes a speaker 302 that allows the user to hear the audible indicator when the dongle is ready for user interaction. The speaker 302 may also be used for providing verbal instructions or indicators. The dongle 301 also includes an LED 303 that allows the user to see the light indicator when the key fob dongle is ready for user interaction. The key fob dongle 301 has a housing 304 that includes a top casing 304(*a*), a bottom casing 304(*b*), and a connector casing 304(*c*). The key fob dongle 301 also includes a circuit board 305 (shown in further detail in FIG. 4) that sits within the housing 304. A connector 306 sits within housing 304 and is used to connect the key fob dongle to the vehicle OBD-II connector.

Figure 4:
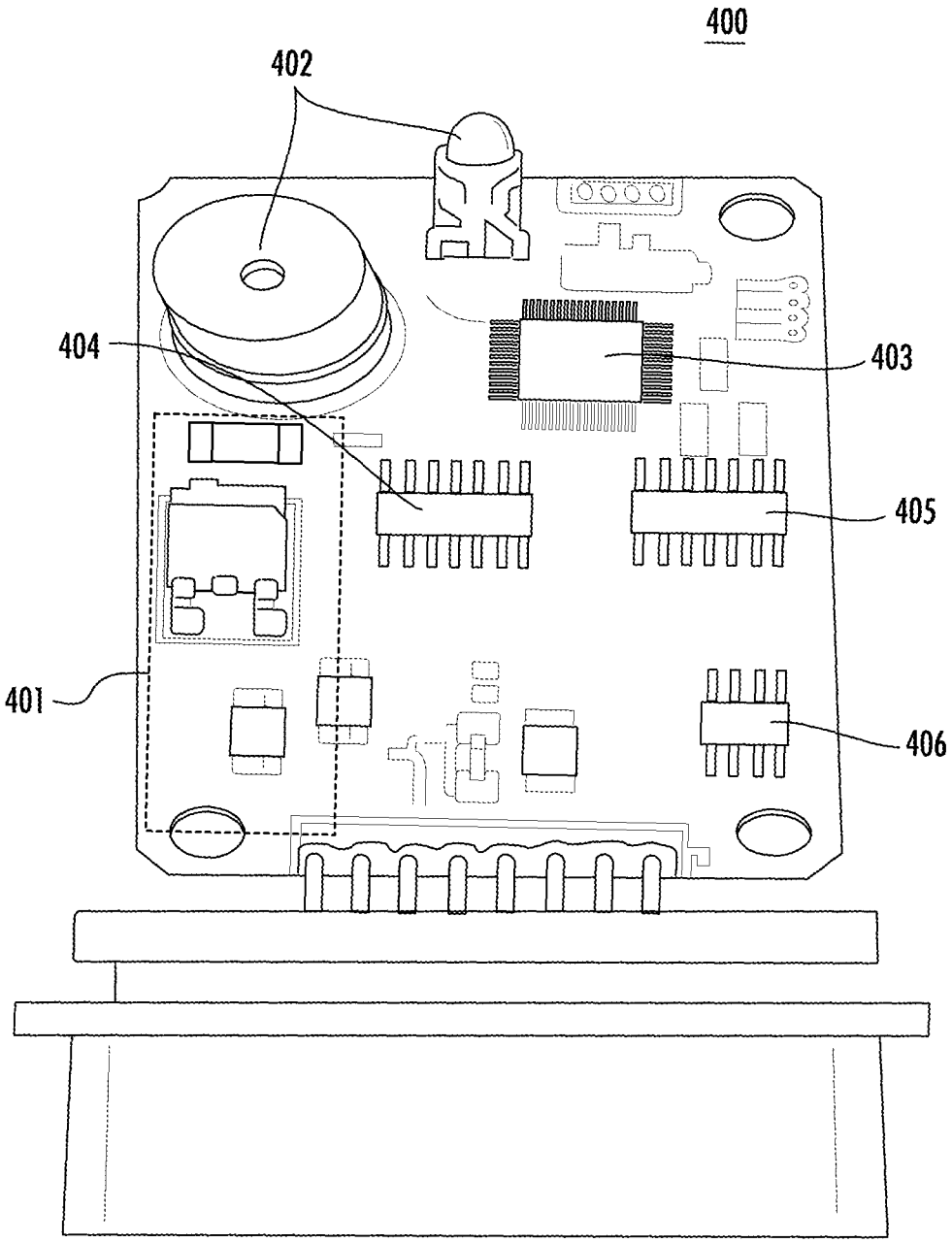
FIG. 4 is an example of the electronics inside the key fob dongle.

FIG. 4 is an example of the electronics inside the key fob dongle. The functionality of the Printed Circuit Board (PCB) is to provide the necessary hardware/software and OBD-II compliant interfaces to communication with the vehicle OBD-II protocols. One design goal was to select the least expensive components that provide the vehicle interfaces required for a line of vehicle makes and models. Another design goal was to optimize the layout of the components to fit the PCB in a small in a 2.5 inch by ⅕ inch space. Another key fob dongle design criteria was to be compliant with the vehicles specific protocol in order to communicate the necessary message frames.

The PCB 400 of FIG. 4 includes a power section 401, an indicator section 402, a micro controller section 403, a J1850 section 404, an SWCAN section 405, and a HSCAN section 406.

The power section 401 regulates to 5 Vdc to drive the microcontroller. The Input power is from OBD-II connector Pin 16—Un-switched Battery+and Power Ground is from OBD-II Pin 4—Chassis Ground. The 5 Vdc regulated power is used for Microcontroller and other peripheral integrated circuits (ICs). The power regulator provides current and protective functions against over temperature and reverse voltage.

The indicator section 402 includes the LED and buzzer. The LED and Buzzer provide visual and audio indication for the user to have easier representation of steps necessary in programming the key-fobs. The key indications are information about the Identity of the vehicle protocol and status of a pairing/learning sequence of each key-fob.

The micro controller section 403 includes a Main Controller Unit (MCU). The MCU used in the design is automotive compliant and minimizes the overall cost of the system while still fulfilling the system specification, for example, performance, reliability, environmental, and the like. The MCU is responsible for the application logic execution with respect to the user requirements and controls the I/O devices connected. The MCE is also responsible for the execution of a sequence of messages based on vehicle identification and user input (Key-fob button press and Vehicle Lock Actuations) to pair with a number of key-fobs. The selected MCU has sufficient I/O pins, necessary peripherals and is powered by a 5 Vdc voltage regulator.

The J1850 section 404 consists of a comparator IC and is connected to the Microcontroller timer capture pin. The comparator compares the received signal and converts to 5V logic to microcontroller. The Microcontroller captures the signal and forms the data to process J1850 protocol logic. The J1850 BUS lines are at OBD-II connector Pin 2—J1850 High and Pin 10—J1850 Low.

The SWCAN section 405 uses an SWCAN transceiver IC to transmit and receive the data between the Microcontroller and Vehicle OBD-II port. The SWCAN works at the rate of 33.33 kbps baud. The SWCAN BUS line is at OBD-II connector Pin 1—SW CAN.

The HSCAN section 406 uses an HSCAN transceiver IC to transmit and receive the data between microcontroller and the Vehicle OBD-II port. The HSCAN works at the rate of 500 kbps baud. The HSCAN BUS lines are at OBD-II connector Pin 6—CAN High and Pin 14—J1850 CAN Low.

Figure 5:
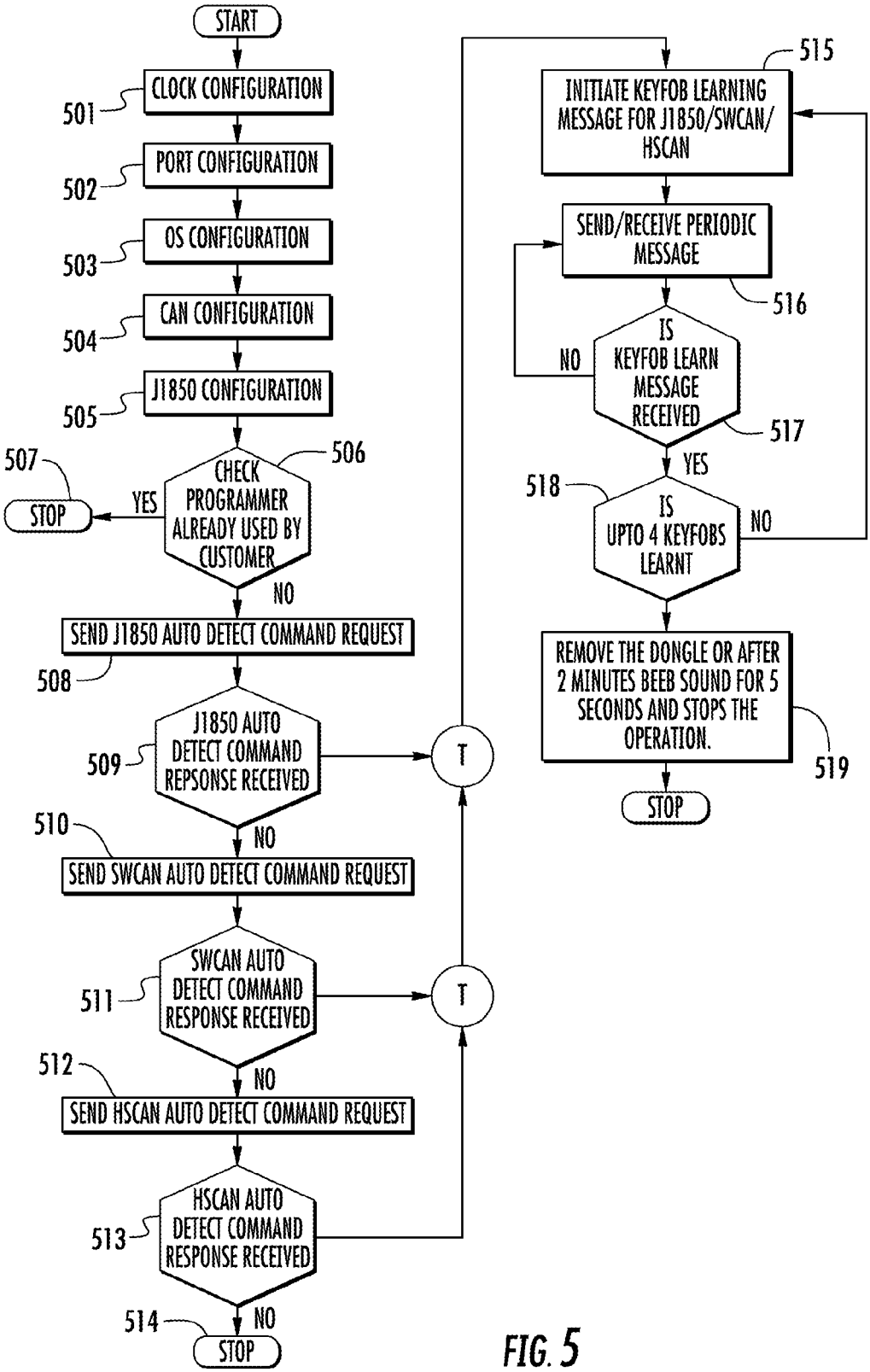
FIG. 5 is an example of a programmer software flowchart.

FIG. 5 is an example of a programmer software flow chart. The software architecture consists of an OS Section, an Interrupt handling Section, a CAN Configuration, a J1850 Configuration, and an Application layer section. The OS Section is the heart-beat of the controller and generates every 1 ms timer count to operate the microcontroller. The Interrupt handling section receives the data and service the application layer without any delay. The CAN Configuration section is used to configure all CAN mail boxes and sets the required baud rate to receive and transmit the CAN data. The J1850 Configuration configures the timer capture input for reception and configures another port as output to transmit the data. It configures the baud rate settings and checks the CRC error check. The Application layer section follows the communication configuration and automatically detects the Vehicle communication protocol once it has been inserted to the OBD-II port. The classification of communication protocol can be detected through the buzzer sound once it has been inserted into the OBD-II port. The Learning Procedure is initiated after the user presses and holds the LOCK and UNLOCK buttons simultaneously in the key fob for 10 seconds. A two minute time-out period is set per session with the buzzer indication to alert the user to remove programmer tool from OBD-II port. The key fob dongle has a built in counter to limit the number of sessions allowed and is a disposable device.

In FIG. 5, the process starts by starting the clock configuration 501, the port configuration 502, the OS configuration 503, the CAN configuration 504, and the J1850 configuration 505. The key fob dongle is then checked 506 to determine if it was already used by a customer. On a condition that the key fob dongle has already been used, then the process stops 507. On a condition that the key fob dongle has not already been used, then a J1850 auto detect command request may be sent 508. It is then determined if a J1850 auto detect command response is received 509.

On a condition that the J1850 auto detect command response is not received, a SWCAN auto detect command request is sent 510. It is then determined if a SWCAN auto detect command response is received 511. On a condition that the SWCAN auto detect command response is not received, a HSCAN auto detect command request is sent 512. It is then determined if an auto detect command response is received 513. On a condition that the HSCAN auto detect command is not received, the process is stopped 514.

On a condition that the J1850/SWCAN/HSCAN auto detect command response is received, the key fob learning message is initiated 515 for J1850/SWCAN/HSCAN. Periodic messages are then sent and received by the key fob dongle 516. It is then determined if the key fob learn message is received 517. On a condition that the key fob lean message is not received, the process repeats the sending and receiving of periodic messages 516. On a condition that the key fob learn message is received, the process determines if up to a maximum number of key fobs have been learnt 518. On a condition that the maximum number of key fobs have not been learnt, the process repeats itself by initiating a key fob learning message for J1850/SWCAN/HSCAN 515. On a condition that the maximum number of key fobs have been learnt, the key fob dongle is either removed or after two minutes a beep will sound for five seconds and the operation stops 519.

Figure 6:
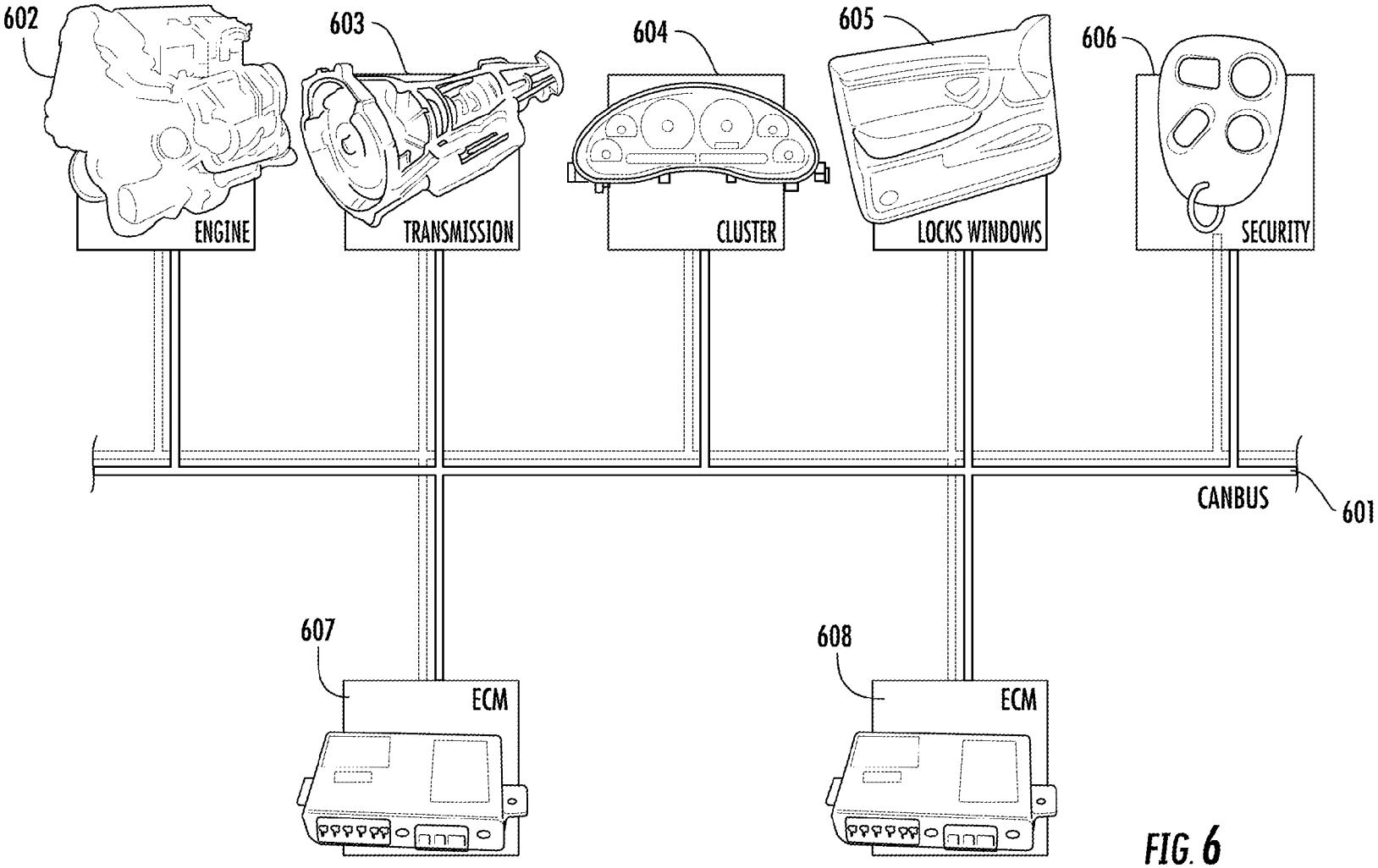
FIG. 6 is an example of an in-vehicle network CAN BUS.

FIG. 6 is an example of an in-vehicle network CAN BUS. The CAN BUS 601 is connected to the engine 602, the transmission 603, the instrument cluster 604, the lock window 605 and the security 606. Additionally, the CAN BUS 601 is connected to the electronic control module (ECM) 607 and the body control module (BCM) 608.

Figure 7:
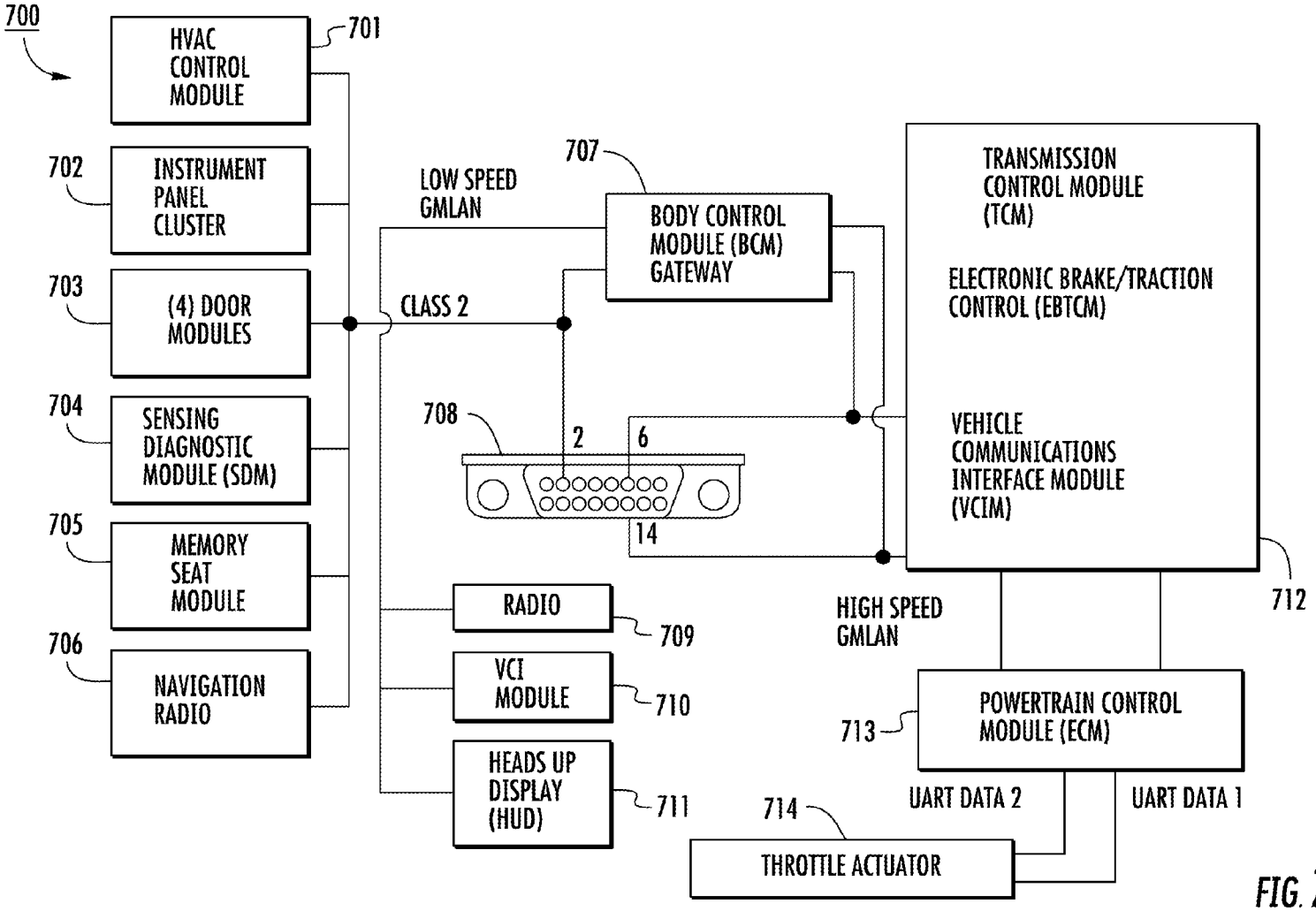
FIG. 7. Is an example of an in-vehicle network OBD-II diagram.

FIG. 7 is an example of an in-vehicle network OBD-II diagram. In FIG. 7, a body control module (BCM) gateway 707 is connected to an HVAC control module 701, an instrument panel cluster 702, (4) door modules 703, a sensing diagnostic module 704, a memory seat module 705, and a navigation radio 706 at a class 2. The BCM gateway 707 is also connected to a radio 709, a VCI module 710, and a head up display (HUD) 711 at low speed GMLAN.

The BCM gateway 707 is connected to the transmission control module (TCM), electronic brake/traction control (EBTCM), and vehicle communications interface module (VCIM) (collectively 712) at a high speed GMLAN. The TCM/EBTCM/VCIM 712 is connected to the powertrain control module (ECM) 713. The ECM 713 is connected to the throttle actuator 714 via UART data 1 and UART data 2. The OBD-II 708 is connected to the BCM gateway 707 and the TCM/EBTCM/VCIM 712

Those of ordinary skill in the art may recognize that many modifications and variations of the above may be implemented without departing from the spirit or scope of the following claims. Thus, it is intended that the following claims cover the modifications and variations provided they come within the scope of the appended claims and their equivalents.

What is claimed:

1. A programming dongle for pairing a key fob transmitter with a vehicle's on-board electronics, the dongle comprising:

a housing;

a connector that is connected to the housing and configured for connecting to a vehicle's on-board electronics through the vehicle's on-board diagnostic (OBD) connector;

a diagnostic circuit in the housing that communicates with the vehicle's on-board electronics through the OBD connector and determines a vehicle's communication protocol selected from a group comprised of: J1850 PWM; J1850 VPW; ISO 9141-2; ISO 14230;

KWP2000; and, ISO 15765 CAN for wireless programming a wireless key fob transmitter;

a first human recognizable signal that indicates a recognition of the vehicle's on-board electronics protocol and initiates an interaction with the vehicle's on board network; and, a second human recognizable signal that indicates a completed programming of a wireless key fob transmitter;

wherein a predetermined human recognizable signal prompts a user to simultaneously press and hold multiple functions on the wireless key fob transmitter to program the wireless key fob transmitter;

whereby the wireless key fob transmitter is paired with the vehicle and the vehicle's on-board electronics are maintained.

2. The dongle of claim 1, wherein the first human recognizable signal varies according to the vehicle's communication protocol.

3. The dongle of claim 1, wherein the first human recognizable signal indicates a J1850 vehicle communication protocol.

4. The dongle of claim 1, wherein the first human recognizable signal indicates a single wire control area network (SWCAN) communication protocol.

5. The dongle of claim 1, wherein the first human recognizable signal indicates a high speed single wire control area network (HSCAN) communication protocol.

6. The dongle of claim 1, wherein a predetermined human recognizable signal prompts a user to simultaneously press and hold lock and unlock functions on the key fob transmitter.

7. The dongle of claim 1, wherein a communications signal sent through the vehicle's on-board electronics seeks confirmation that the key fob is programmed to communicate with the vehicle.

8. The dongle of claim 1, wherein the dongle connects to the vehicle's on-board electronic through a Data Link Connector.

9. A programming dongle for a key fob transmitter, the dongle comprising:

a housing;

a connector that is connected to the housing and configured for connecting to a vehicle's on-board electronics through the vehicle's on-board diagnostic (OBD) connector;

a diagnostic circuit that communicates with the vehicle's on-board electronics through the OBD connector and determines a vehicle's communication protocol for wireless programming a wireless key fob transmitter;

a signal generator that indicates a recognition of the vehicle's on-board electronics protocol and initiates an interaction with the vehicle; and, a signal generator that indicates a completed programming of a key fob transmitter.

10. The dongle of claim 9, wherein the dongle connects to the vehicle's on-board electronic through a Data Link Connector.

11. The dongle of claim 9, wherein the dongle communicates with the vehicle's on-board electronic through a communication protocol selected from a group comprised of: J1850 PWM; J1850 VPW; ISO 9141-2; ISO 14230; KWP2000; and, ISO 15765 CAN.

12. A dongle for programing a key fob transmitter to a vehicle, the dongle comprising:

a connector that has a plurality of interfaces and mates with a vehicle's on-board electronics;

a diagnostic circuit that determines the vehicle's communication protocol for its on-board electronics and a protocol for programming a key fob transmitter to the vehicle;

a signal generator that responds to an identified protocol and initiates an interaction between a wireless key fob transmitter and the vehicle's on-board electronics; and, a signal generator that indicates successful programming of the wireless key fob transmitter to the vehicle.

13. The dongle of claim 12, wherein the dongle mates to the vehicle's on-board electronic through a Data Link Connector.

14. The dongle of claim 12, wherein the dongle communicates with the vehicle's on-board electronic through a communication protocol selected from a group comprised of: J1850 PWM; J1850 VPW; ISO 9141-2; ISO 14230; KWP2000; and, ISO 15765 CAN.

15. The dongle of claim 12 wherein the dongle is preprogramed for a predetermined class of vehicles.

16. The dongle of claim 15 wherein the dongle is preprogrammed for a specific vehicle within the predetermined class of vehicles.

* * * * *